US005634299A

United States Patent [19]

Gaston

[11] Patent Number: 5,634,299

[45] Date of Patent: Jun. 3, 1997

[54] GUTTER SCREENING APPARATUS

[76] Inventor: Claire F. Gaston, 601 11th St., Linclon, Ill. 62656-1981

[21] Appl. No.: 431,278

[22] Filed: Apr. 28, 1995

[51] Int. Cl.[6] ..... E04D 13/076

[52] U.S. Cl. ..... 52/12; 52/16; 210/163; 210/477

[58] Field of Search ..... 52/11, 12, 14, 52/15, 16; 210/162, 163, 164, 165, 460, 462, 477

[56] References Cited

U.S. PATENT DOCUMENTS

| | | | |
|---|---|---|---|
| 753,660 | 3/1904 | Boyer | 52/11 |
| 4,116,008 | 9/1978 | Ward | 52/12 |
| 4,998,386 | 3/1991 | Baumgarth | 52/11 |
| 5,095,666 | 3/1992 | Williams, Jr. | 52/11 |

FOREIGN PATENT DOCUMENTS

| | | | |
|---|---|---|---|
| 3703320 | 11/1988 | Germany | 52/12 |

*Primary Examiner*—Michael Safavi

*Attorney, Agent, or Firm*—G. Brian Pingel; Brett J. Trout

[57] ABSTRACT

A flushing apparatus for collecting and removing debris from a rain gutter to permit the unobstructed flow of water through a gutter downspout. The apparatus includes a channel section forming one end of the gutter and having a pair of sidewalls, a screen member and a raised portion associated with the screen member. The raised portion is of a height sized to induce water in the gutter to drop through the screen member into the downspout. The screen member is pivotable between a normal position which prevents the debris from passing into the downspout, and a cleaning position which removes the debris from the screen member.

4 Claims, 5 Drawing Sheets

GUTTER SCREENING APPARATUS

BACKGROUND OF THE INVENTION

1. Field of the Invention

The present invention relates in general to an apparatus for the flushing of debris from rain gutters, and more specifically to such apparatus having an operation based upon the flushing action of water flowing in the gutter.

2. Description of the Prior Art

Rain gutters associated with the eaves of buildings are well-known to become filled with debris that prevents the passage of rainwater to and out the downspouts of the gutter system. A variety of devices are known in the art to provide a means that facilitates the task of cleaning the debris from rain gutters; for example, see U.S. Pat. Nos. 3,023,971; 4,972,863 and 5,119,849.

The U.S. Pat. No. '971 patent discloses a gutter cleaning device comprised of a handle specifically designed to support a length of hose so that the hose can be raised to the height of the gutter for providing a flushing fluid source to the gutter to wash debris therefrom.

The U.S. Pat. No. '863 patent discloses a gutter cleaning apparatus that also depends upon the providing of a flushing fluid to the gutter. However, the apparatus of such patent comprises a device attachable to one end of the gutter and to a garden hose and includes discharge orifices that directs streams of the flushing fluid along the length of the gutter to clean debris therefrom.

The U.S. Pat. No. '849 patent discloses an apparatus designed to be utilized and located in the downspout of a rain gutter system. Such apparatus is formed of a flushing supply and a downspout valve unit that can block the downward end of the downspout. In operation, the downspout valve is actuated to block the downward end of the downspout. A flushing agent is then supplied to the downspout by the flushing supply unit until water fills the downspout and the rain gutter so that loose debris in the gutter eventually overflows the edges of the gutter. The fluid supply unit is then shut off and the flushing agent is allowed to sit in the gutter and downspout for a selected period of time sufficient so that the remaining debris in the gutter is either dissolved or suspended in the water. At the end of such period, the flushing agent is then permitted to run from the gutter system by means of a diverter aperture in the downspout.

Although the above described devices are adapted to provide assistance in the maintenance of rain gutter systems, none of them are known to be currently in widespread usage. The present invention is designed to provide an efficient and relatively simplistic gutter flushing apparatus that can be used in connection with almost any building rain gutter system.

SUMMARY OF THE INVENTION

The present invention provides a flushing apparatus for collecting and removing debris from a rain gutter. The apparatus includes a channel means forming one end portion of the gutter and having a pair of sidewalls and a screen member serving as the floor of the channel means and extending between said sidewalls. The screen member has perforations that permit water to flow therethrough and are sized to screen debris from the water.

Located in the channel means is a raised portion that is associated with said screen member and is extended between the sidewalls to serve as an end wall of the gutter. Such raised portion is sized to induce water in the gutter to drop through the screen member into a downspout and to permit debris collected on the screen member to be urged toward and over the raised portion by the gutter water to drop from the gutter.

Preferably, the screen member is pivotally attached to the sidewalls of the channel means so that the screen member is movable from a normal position screening the water flowing through the gutter to a cleaning position for removal of debris therefrom. A lever means is associated with said screen member and is utilized for controlling the movement of such member from said normal position to said cleaning position.

DETAILED DESCRIPTION OF THE PREFERRED EMBODIMENT

Figure 1:
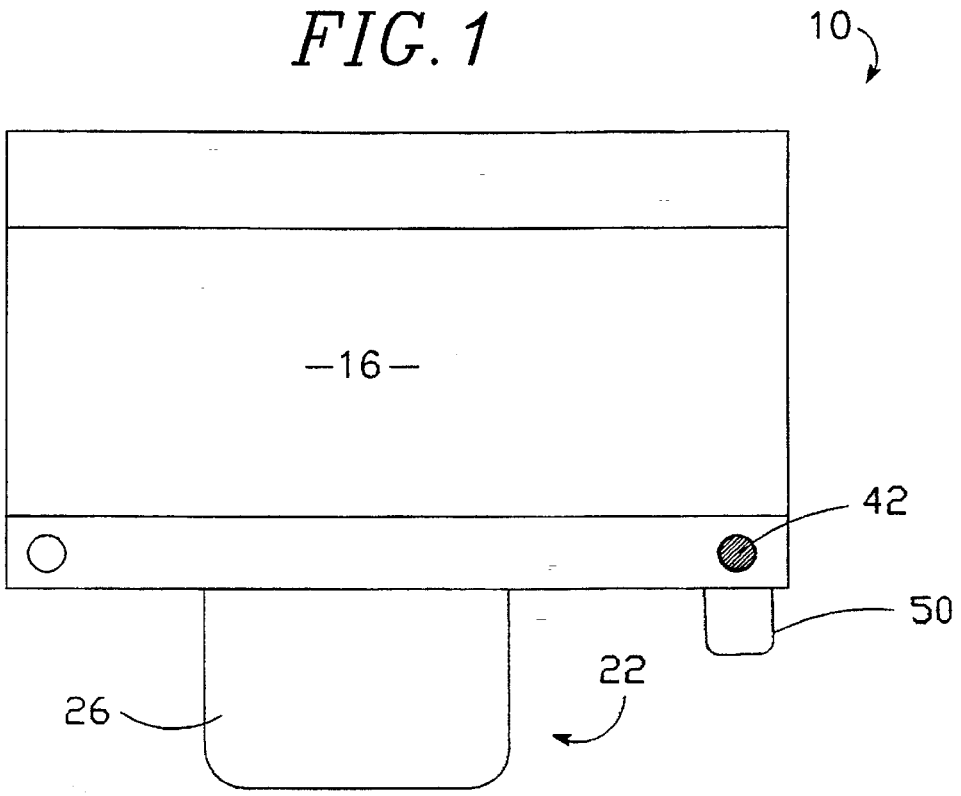
FIG. 1 is a left side view of a preferred embodiment of the gutter flushing apparatus of the present invention.
Figure 3:
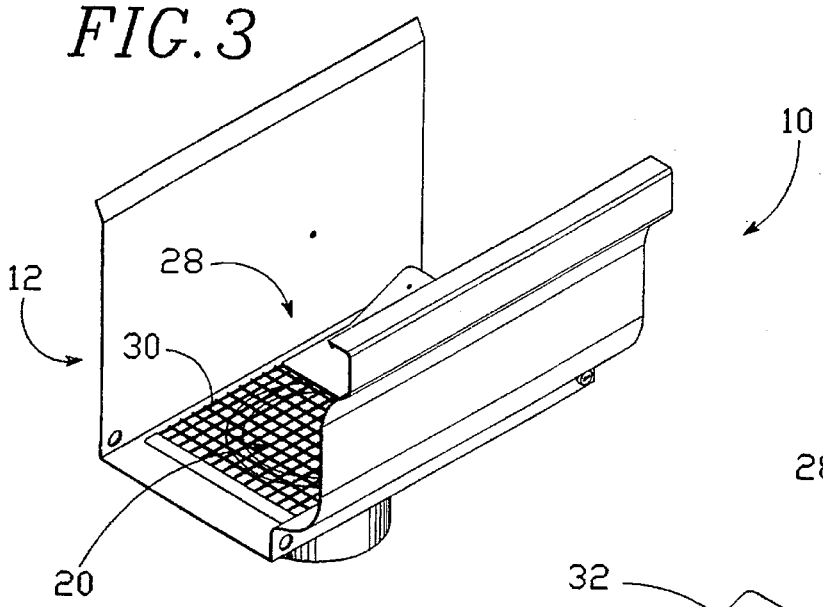
FIG. 3 is an enlarged, foreshortened, perspective view of the gutter flushing apparatus of FIG. 1.
Figure 7:
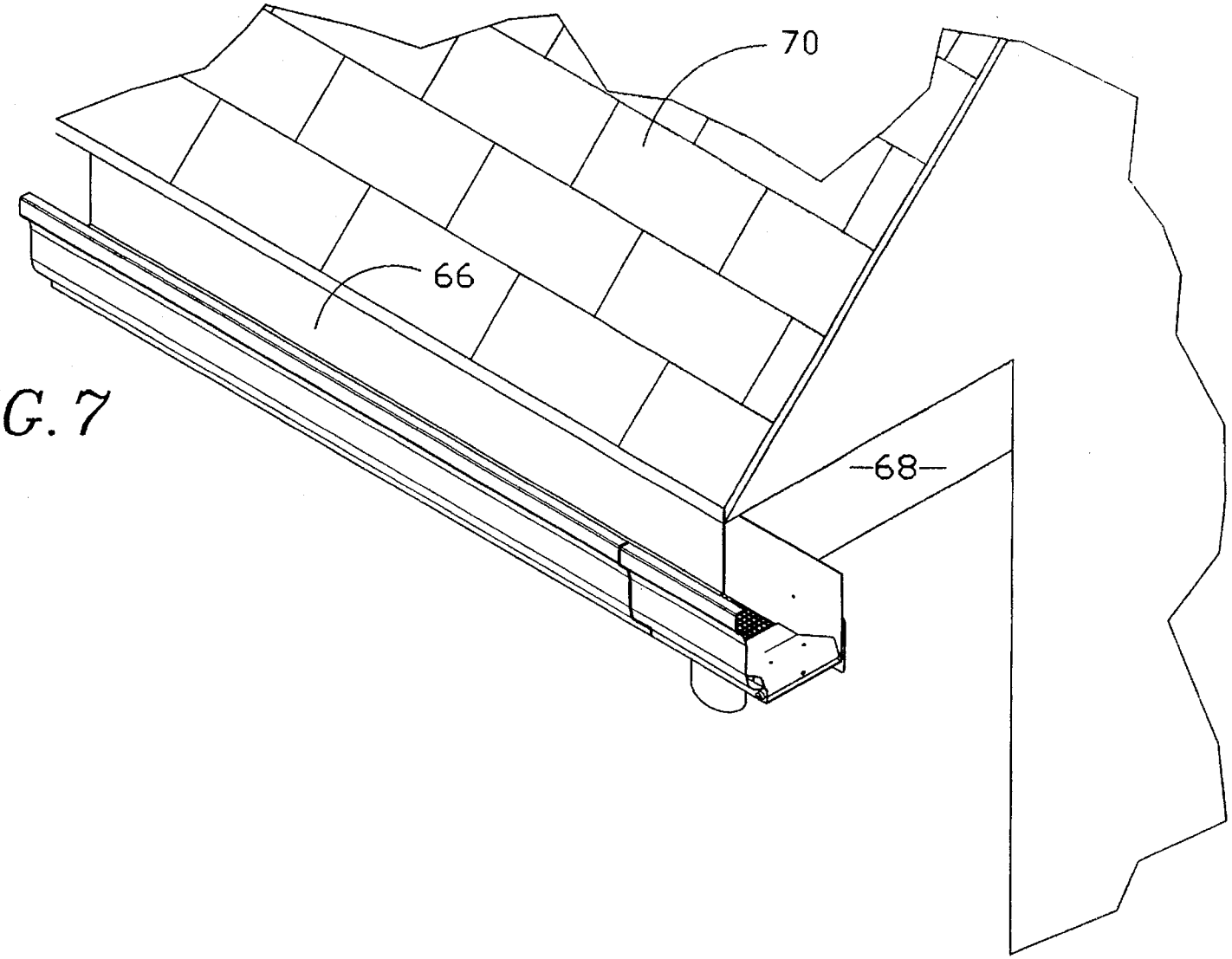
FIG. 7 is a perspective view showing the embodiment of FIG. 1 attached to a standard house gutter.

With reference to the drawings, a rain gutter and downspout flushing apparatus of the present invention is indicated generally as 10 in FIG. 1. As shown in FIG. 3, the apparatus 10 includes a channel 12, a screening apparatus 28 pivotally connected to the channel 12, and a drain 20 through which water exits the channel 12. As indicated by FIG. 7, the apparatus 10 is readily adaptable to a typical gutter system 66 mounted to an eave 68, of a structure 70.

Figure 4:
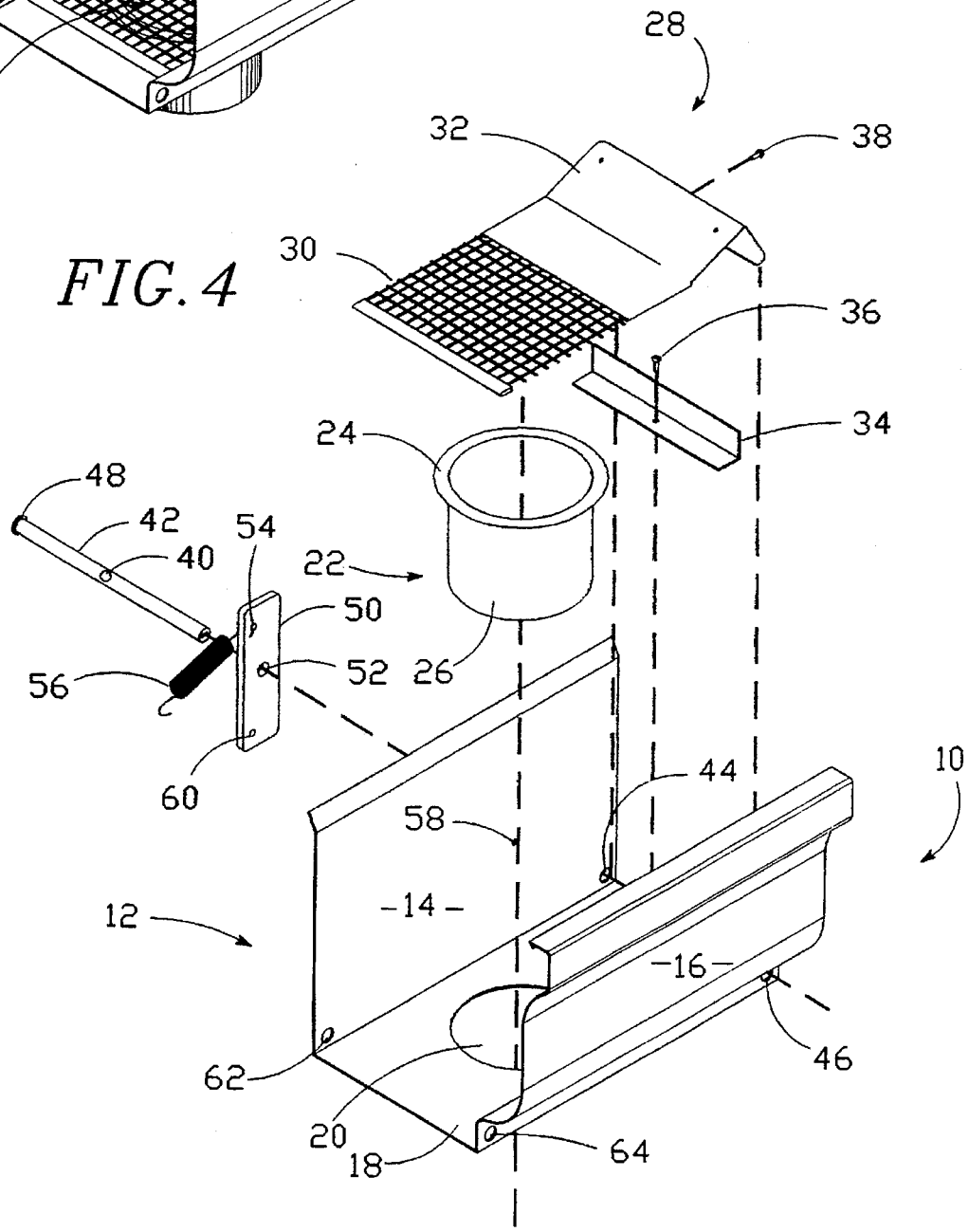
FIG. 4 is an exploded view of the gutter flushing apparatus of FIG. 1.

Referring now to FIG. 4, the channel 12 includes a rear sidewall 14, a front sidewall 16, and a floor 18. Provided in the floor 18 is a circular drain 20 through which water exits the channel 12. Inserted into the drain 20 is a drain guide 22 having a lip 24 and a body 26. The lip 24 of the drain guide 22 rests on the floor 18 of the channel 12 and prevents the drain guide 22 from passing completely through the drain 20. The body 26 of the drain guide 22 guides water downward from the channel 12 and prevents water from traveling across the underside of the floor 18 of the channel 12.

Provided over the drain guide 22 is a screening apparatus 28 (FIG. 4). The screening apparatus 28 includes a screen 30 secured to a raised wall 32. The raised wall 32 is designed to accommodate an end piece 34 secured to the floor 18 of the channel 12. The end piece 34 is secured to the floor 18 by a screw 36 or similar attachment means and extends from the rear sidewall 14 to the front sidewall 16, thereby forcing water to exit the channel 12 through the drain 20.

The screening apparatus 28 is pivotally secured to the channel 12 by a screw 38 passing through a hole 40 in a pivotable pin 42. The pin 42 passes through a first hole 44 in the rear sidewall 14 and a second hole 46 in the front sidewall 16 which allows the pin 42 to pivot in relationship to the channel 12. The pin 42 is provided with a head 48 which prevents the pin 42 from becoming inadvertently dislodged from the channel 12. The head 48 of the pin 42 is welded or otherwise secured to a lever 50 through a hole 52 provided in the lever 50. Accordingly, as the lever 50 is pivoted, the pin 42 and the screening apparatus 28 attached thereto are also pivoted.

Figure 2:
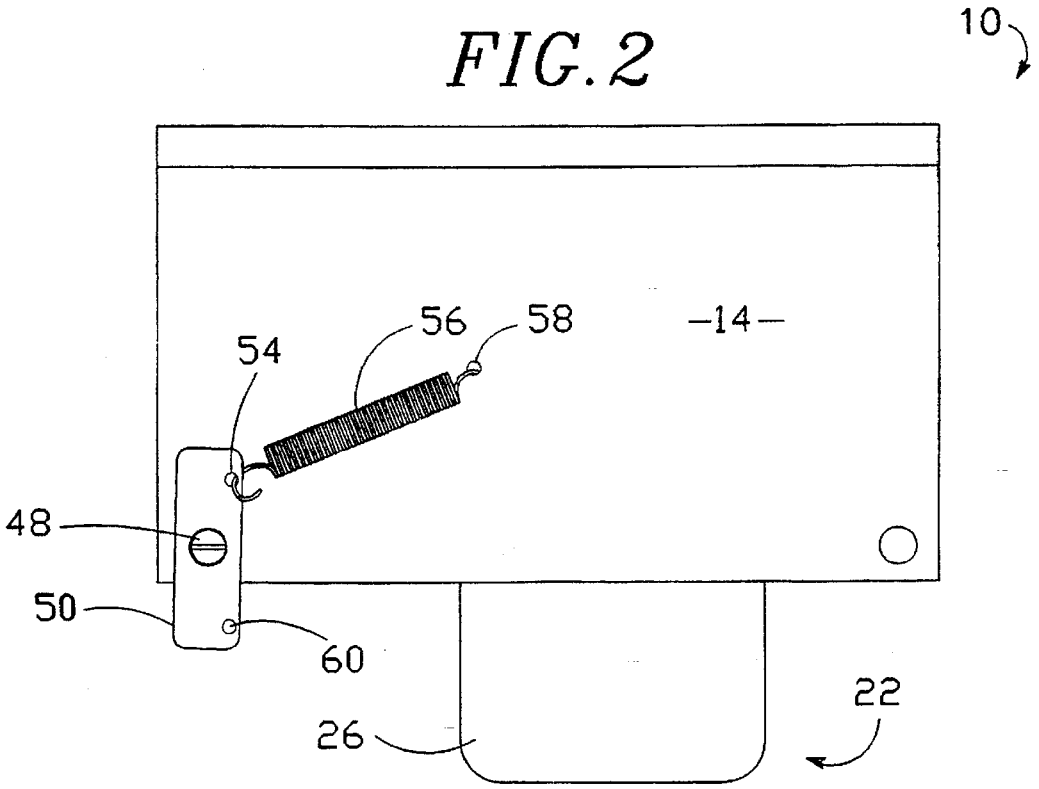
FIG. 2 is a right side view of the gutter flushing apparatus of FIG. 1.

The lever 50 is provided with a first hole 54 through which a coil spring 56 is connected from the lever 50 to the rear sidewall 14 through a spring hole 58 (FIG. 2). In addition to biasing the lever 50, the coil spring 56 biases the pin 42 against inadvertent dislodgement from the holes 44 and 46 in the channel 12. Preferably, the lever 50 is also provided with a second hole 60 for attachment to an actuation cable (not shown) or similar actuator.

The rear sidewall 14 of the channel means is provided with a first connection hole 62, while the front sidewall 16 is provided with a second connection hole 64 (FIG. 4). These holes 62 and 64 are preferably aligned with matching holes (not shown) provided in the gutter system 66 (FIGS. 4 and 7). Thereafter screws (not shown) or similar securement means are passed through the holes 62 and 64 to secure the channel 12 to the gutter system 66 as shown in FIG. 7.

As shown in FIG. 3, when the apparatus 10 is fully assembled and in its normal operating position, the screen 30 is positioned over the drain 20, thereby preventing leaves (not shown) or similar debris from passing through the drain 20 and creating a clog or stoppage in the drain 20. While the screen 30 may be of various mesh sizes, it is preferable to provide the smallest mesh size which does not impede the flow of water through the drain 20 once a moderate amount of debris has fallen into the gutter system 66 (FIGS. 3 and 7).

Figure 5:
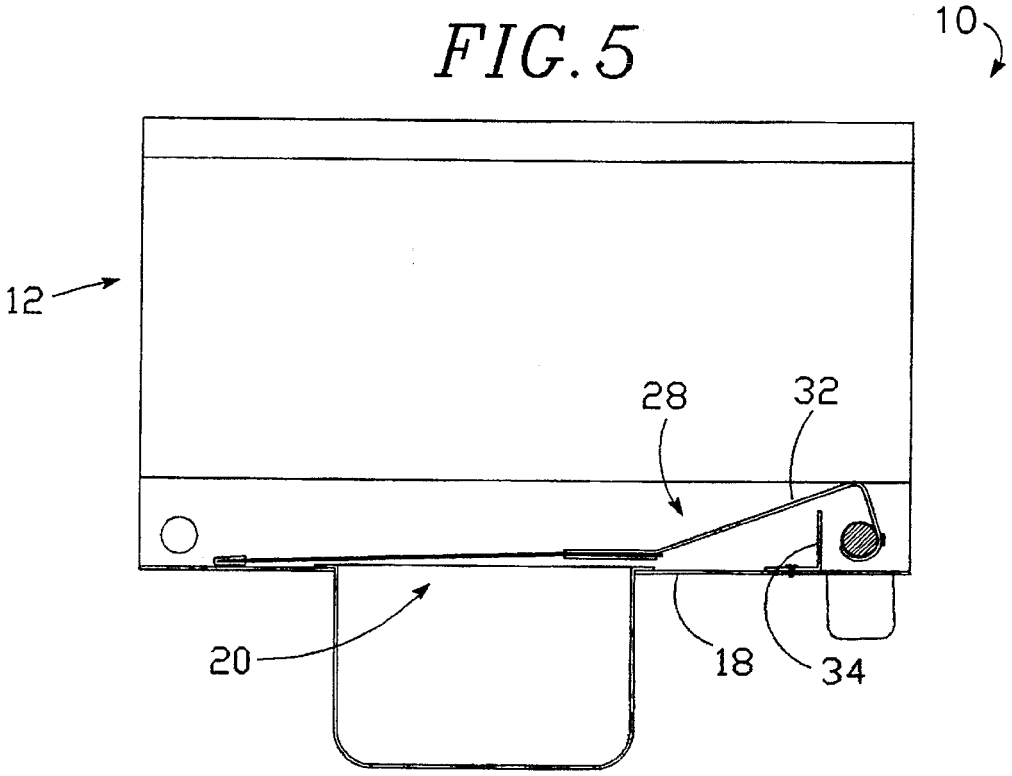
FIG. 5 is a left side cross-sectional view of the gutter flushing apparatus of FIG. 1, showing the apparatus in a normal operating position.

As shown in FIG. 5, the apparatus 10 is designed to allow all water passing through the channel 12 to exit the channel 12 via the drain 20. Should any water pass across the floor 18 of the channel 12 without passing through the drain 20, the raised wall 32 of the screening apparatus 28 and the end piece 34 coact to pool and maintain the water within the channel 12 until the water flow subsides enough to allow passage of the water through the drain 20.

After a large amount of debris has been captured and retained by the screen 30, water will no longer be able to pass out of the channel 12 through the drain 20 (FIG. 5). At this point, water will pool and rise over the raised wall 32 and end piece 34, and begin to exit through the end of the channel 12.

Figure 6:
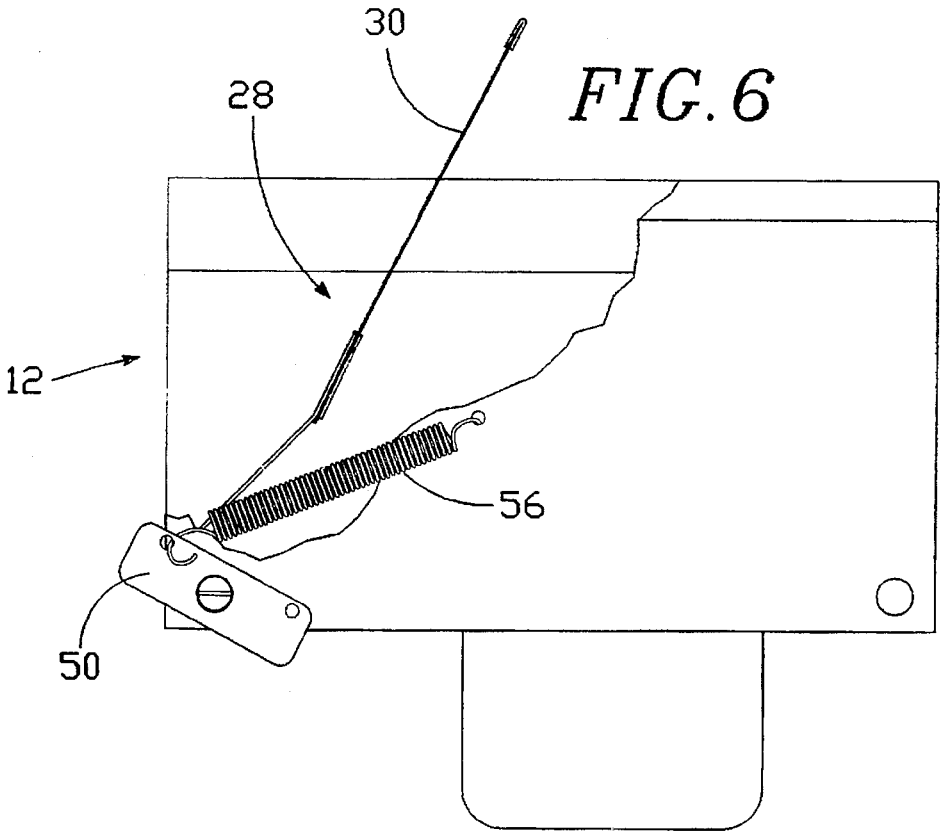
FIG. 6 is a right side view of the gutter flushing apparatus of FIG. 1, but with a portion of a sidewall cut away to better show the invention and the screen member rotated to a cleaning position.

Once the screen 30 has been sufficiently clogged with debris, the cable or similar actuation means is used to pivot the lever 50 and the screening apparatus 28 as shown in FIG. 6. When the screening apparatus 28 stops its pivotal movement, inertia and gravity force debris off of the screen 30. For more stubborn debris the lever 50 may be rapidly pivoted multiple times. For extremely stubborn debris, the lever 50 may be pivoted to move the screen 30 outwardly over the end of the channel 12 where the screen 30 may be flushed with a high pressure water source (not shown). Once the screen 30 has been cleared of debris, the lever 50 is released, thereby allowing the coil spring 56 to rotate the screening apparatus 28 from the cleaning position of FIG. 6, to the normal operating position of FIG. 5.

Figure 8:
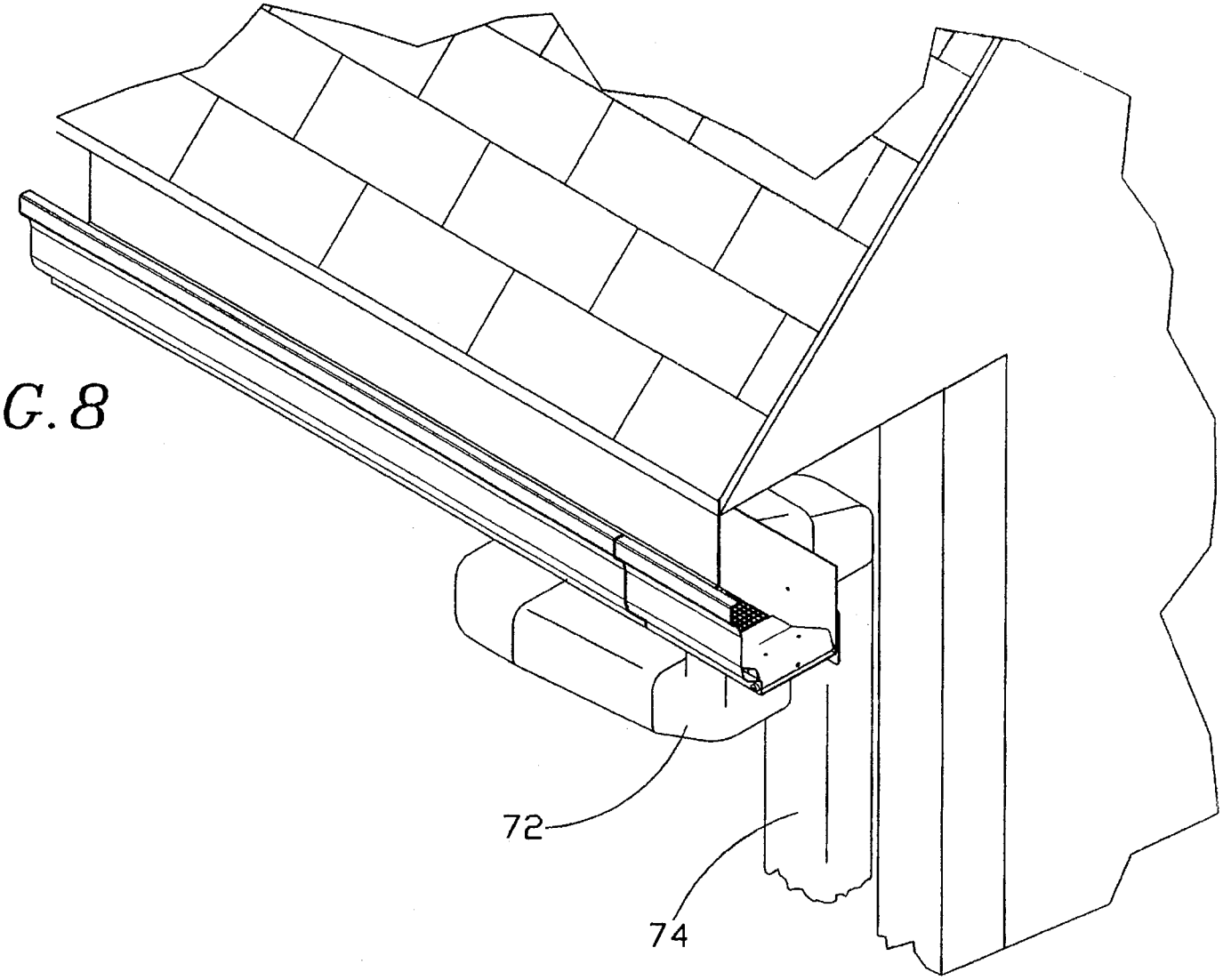
FIG. 8 is a perspective view showing the embodiment of FIG. 1 attached between a standard house gutter and a downspout.

As shown in FIG. 8, the drain guide 22 may be positioned within a downspout extender 72. Preferably the downspout extender 72 is curved to direct water from the drain 20 directly to an existing downspout 74. The use of the downspout extender 72 eliminates the need to cut the existing gutter system 66 to accommodate the apparatus 10 of the present invention.

Although the invention has been described with respect to a preferred embodiment thereof, it is to be understood that it is not to be so limited, since changes and modifications can be made therein which are within the full intended scope of this invention as defined by the appended claims. For example, it is anticipated that a stationary screen may be provided over the drain 20 to prevent the passage of debris through the drain 20 while the screening apparatus 28 is in the cleaning position shown in FIG. 6.

What is claimed is:

1. A flushing apparatus for collecting and removing debris from a rain gutter to permit the unobstructed flow of water through a gutter downspout, said apparatus comprising:

(a) channel means for forming one end portion of the gutter and having:

(1) a pair of sidewalls;

(2) a screen member serving as the floor of said means and extending between said sidewalls, said screen member having perforations that permit water to flow therethrough and are sized to screen debris from the water;

(b) a raised portion associated with said screen member and extended between said sidewalls to serve as a partial end wall of said gutter;

(c) said raised portion has a height sized to induce water in the gutter to drop through said screen member into said downspout and permit debris collected on the screen member to be urged toward and over said raised portion by said water to drop from said gutter; and (d) one end of said screen member is pivotally attached to said sidewalls so that said member is movable from a normal position screening the water flowing through said gutter to a cleaning position for removal of debris therefrom.

2. The flushing apparatus as described in claim 1 where said apparatus further includes lever means associated with said screen member for controlling the movement of said member from said normal position to said cleaning position.

3. The flushing apparatus as described in claim 2 wherein said gutter downspout forms part of an existing gutter system and is horizontally offset from said screen member and said apparatus further includes a downspout extender located below said screen member to direct the water that drops through said screen member to the downspout.

4. The flushing apparatus as described in claim 3 wherein said raised portion is formed on said one end of the screen member.

* * * * *